US006964062B1

(12) United States Patent
Chen

(10) Patent No.: US 6,964,062 B1
(45) Date of Patent: Nov. 15, 2005

(54) CATCHER'S LEG GUARD

(75) Inventor: Shyan-Wei Chen, Taipei Hsien (TW)

(73) Assignee: Recar Racer Sporting Goods Co., Ltd., Taipei Hsien (TW)

( * ) Notice: Subject to any disclaimer, the term of this patent is extended or adjusted under 35 U.S.C. 154(b) by 2 days.

(21) Appl. No.: 10/843,316

(22) Filed: May 12, 2004

(51) Int. Cl.[7] ..... A41D 13/00
(52) U.S. Cl. ..... 2/22
(58) Field of Search ..... 2/22, 24, 16, 455, 2/242, 908, 911; 128/878, 882; 602/23, 26, 602/62

(56) References Cited

U.S. PATENT DOCUMENTS 5,297,294 A * 3/1994 Washick ..... 2/22
5,301,370 A * 4/1994 Henson ..... 2/22
5,794,261 A * 8/1998 Hefling ..... 2/16
5,842,475 A * 12/1998 Duback et al. ..... 128/846
6,178,556 B1 * 1/2001 Foreman et al. ..... 2/22
6,415,441 B1 * 7/2002 Nelson ..... 2/22
6,553,572 B2 * 4/2003 Fiorini et al. ..... 2/22
6,789,264 B2 * 9/2004 Budda ..... 2/22

* cited by examiner

*Primary Examiner*—Tejash Patel
(74) *Attorney, Agent, or Firm*—Troxell Law Office, PLLC

(57) ABSTRACT

A catcher's leg guard includes an ankle pad, a shin pad, a knee pad, a thigh pad, a plurality of connecting belts connected between the knee pad and the thigh pad, a plurality of adjustment straps respectively stitched to the shin pad, the knee pad, and the thigh pad, and a plurality of breathing gauze cloth linings respectively covered on the ankle pad, the shin pad, the knee pad and the thigh pad at an inner side for direct contact with the user's skin, air vents extended through the ankle pad, the shin pad, the knee pad and the thigh pad in air-communication with open spaces in the breathing gauze cloth linings, and an inner knee pad detachably adjustably fastened to the knee pad with hook and loop materials, the ankle pad, the shin pad, the knee pad and the breathing gauze cloth linings being respectively coated with a micro-organism resisting and mildew-retarding treatment agent.

3 Claims, 6 Drawing Sheets

CATCHER'S LEG GUARD

BACKGROUND AND SUMMARY OF THE INVENTION

The present invention relates to a catcher's leg guard adapted to protect the leg of a baseball game catcher and more particularly, to an improved structure of catcher's leg guard, which the ankle pad, shin pad, knee pad and thigh pad thereof provided with air vents and covered with a respective breathing gauze cloth lining for comfortable wearing.

FIG. 1 illustrates a catcher's leg guard according to the prior art. This structure of catcher's leg guard has air vents 71, however, it is still not comfortable in use. The user's leg starts to give out sweat a few minutes after having the catcher's leg guard put on the leg when hot. FIG. 2 shows another structure of catcher's leg guard according to the prior art. According to this design, the guard body 81 of the catcher's leg guard 8 has a breathing cloth lining 81 for ventilation and expelling of sweat. However, the sweat-expelling effect of this structure of catcher's leg guard is still not significant.

The present invention has been accomplished under the circumstances in view. According to one aspect of the present invention, the catcher's leg guard is comprised of an ankle pad, a shin pad, a knee pad, a thigh pad, a plurality of connecting belts connected between the knee pad and the thigh pad, a plurality of adjustment straps respectively stitched to the shin pad, the knee pad, and the thigh pad, and a plurality of breathing gauze cloth linings respectively covered on the ankle pad, the shin pad, the knee pad and the thigh pad at an inner side for direct contact with the user's skin, wherein the ankle pad, the shin pad, the knee pad and the thigh pad ach have a plurality of air vents through the front and back sides in air-communication with open space4s in the breathing gauze cloth linings. According to another aspect of the present invention, the ankle pad, the shin pad, the knee pad and the breathing gauze cloth linings are respectively coated with a micro organism-resisting and mildew-retarding treatment agent. According to still another aspect of the present invention, an inner knee pad is detachably adjustably fastened to the knee pad with hook and loop materials.

DETAILED DESCRIPTION OF THE INVENTION

Figure 1:
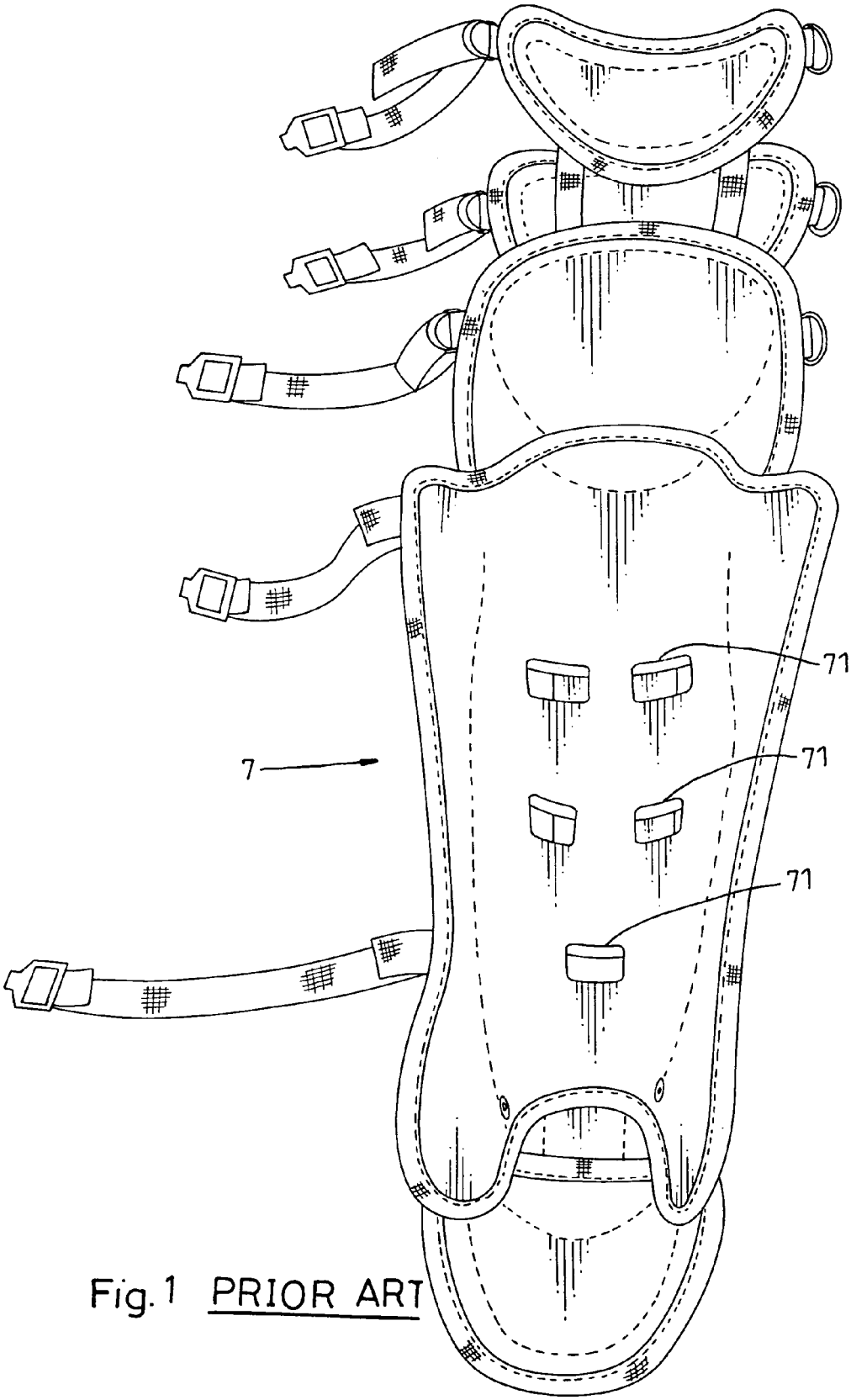
Fig. 1 PRIOR ART
FIG. 1 is a perspective view of a catcher's leg guard according to the prior art.
Figure 2:
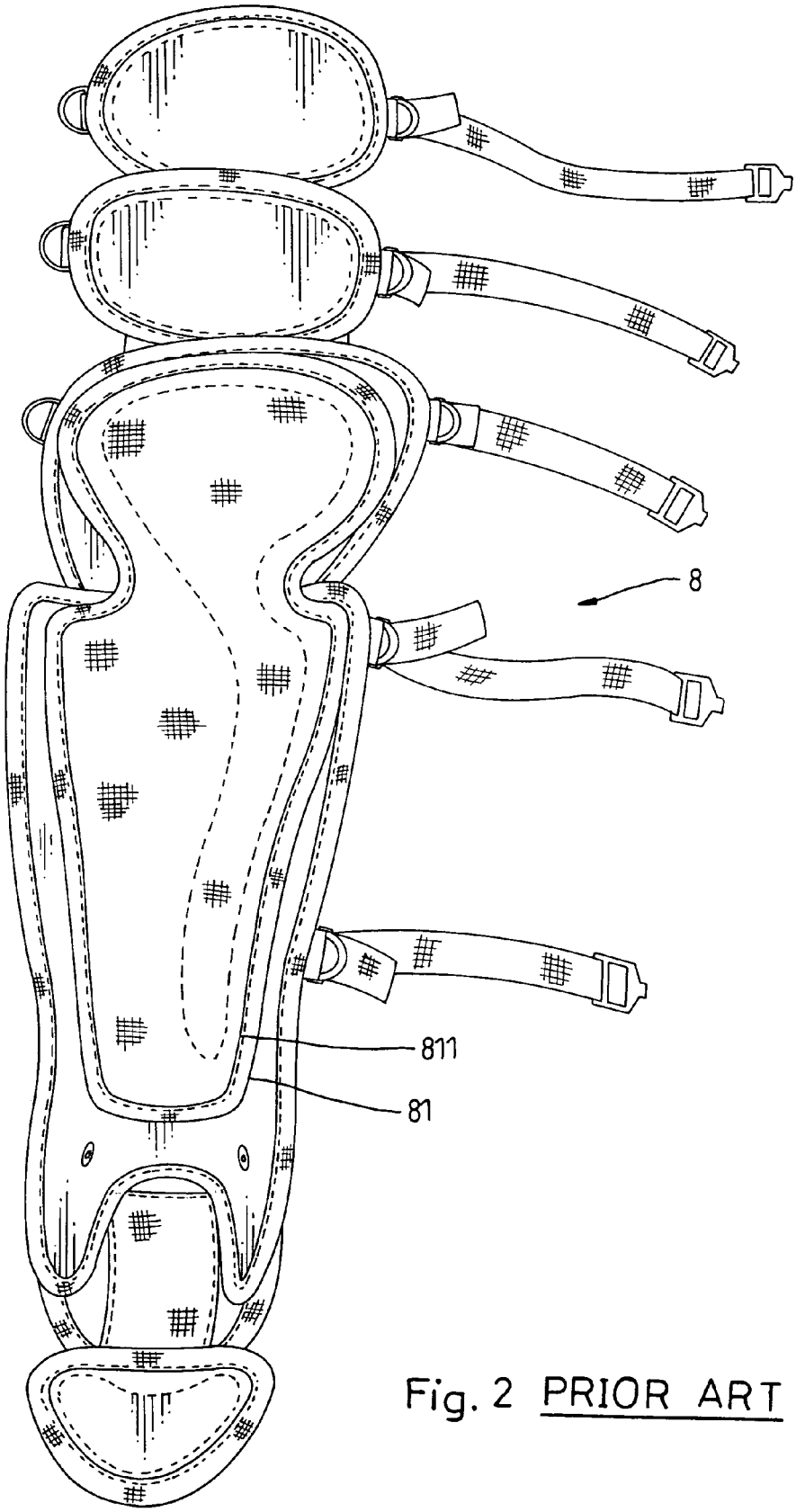
Fig. 2 PRIOR ART
FIG. 2 is a perspective view of another structure of catcher's leg guard according to the prior art.
Figure 3:
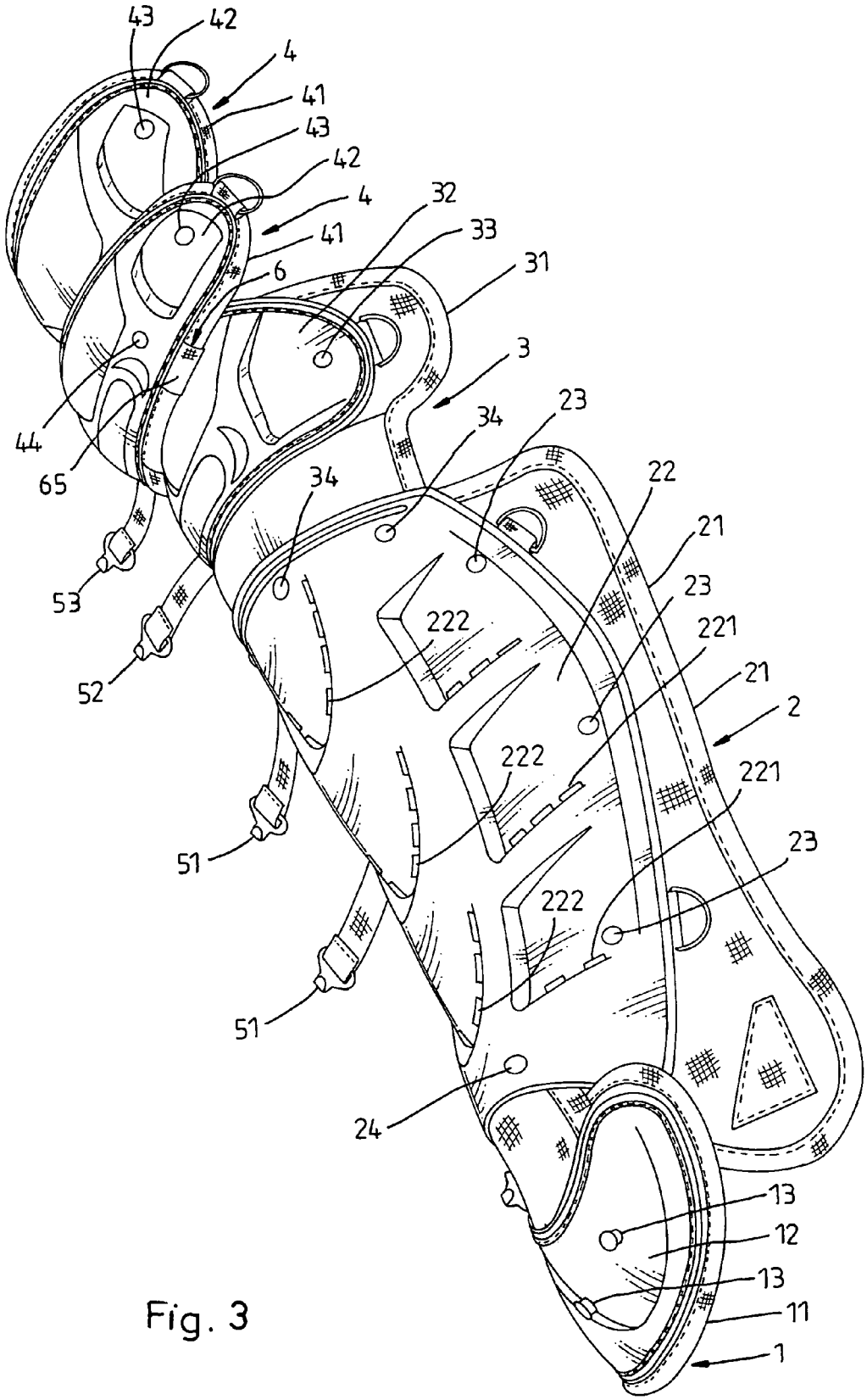
FIG. 3 is a perspective view of a catcher's leg guard according to the present invention.
Figure 4:
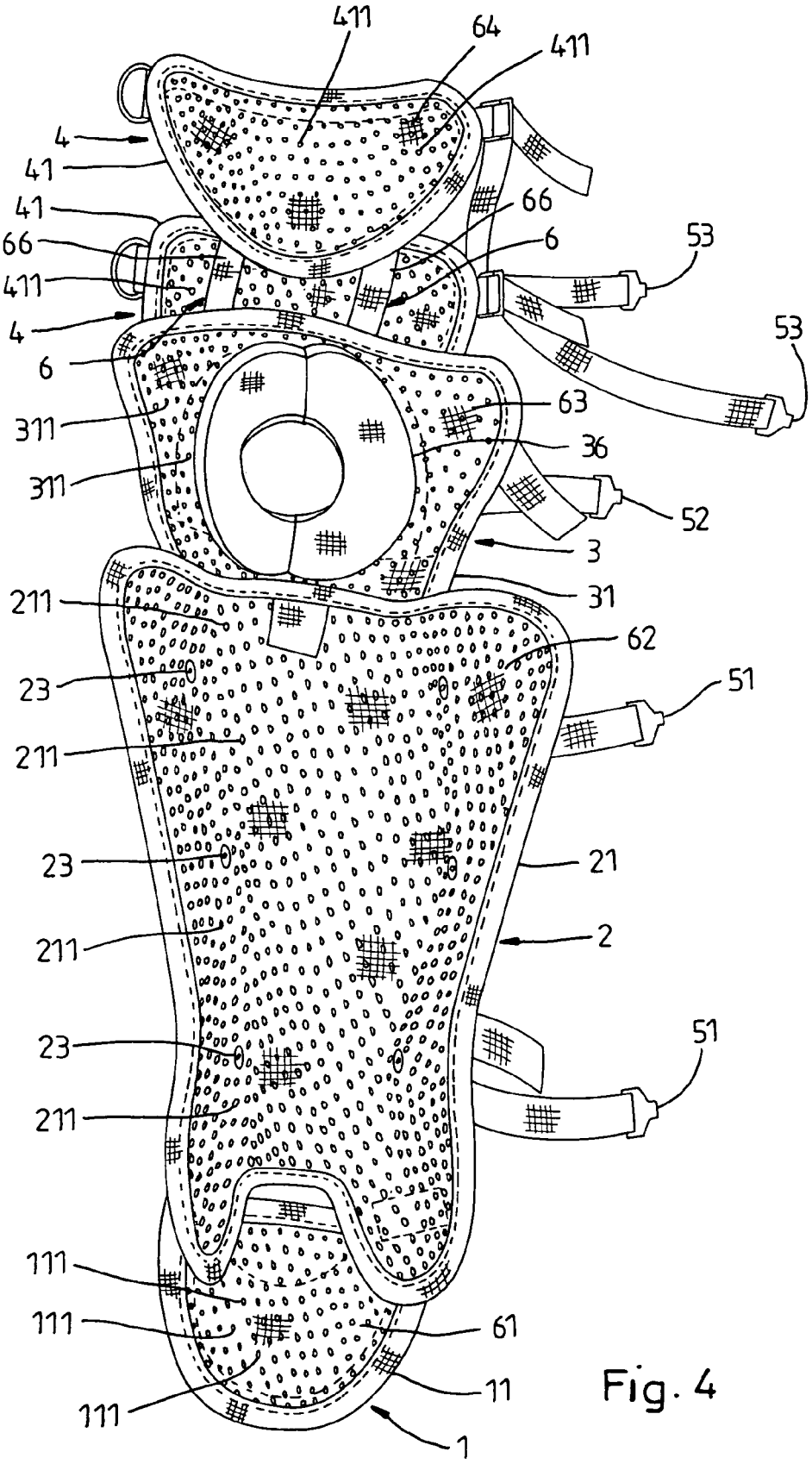
FIG. 4 is a rear side view of the catcher's leg guard according to the present invention.
Figure 5:
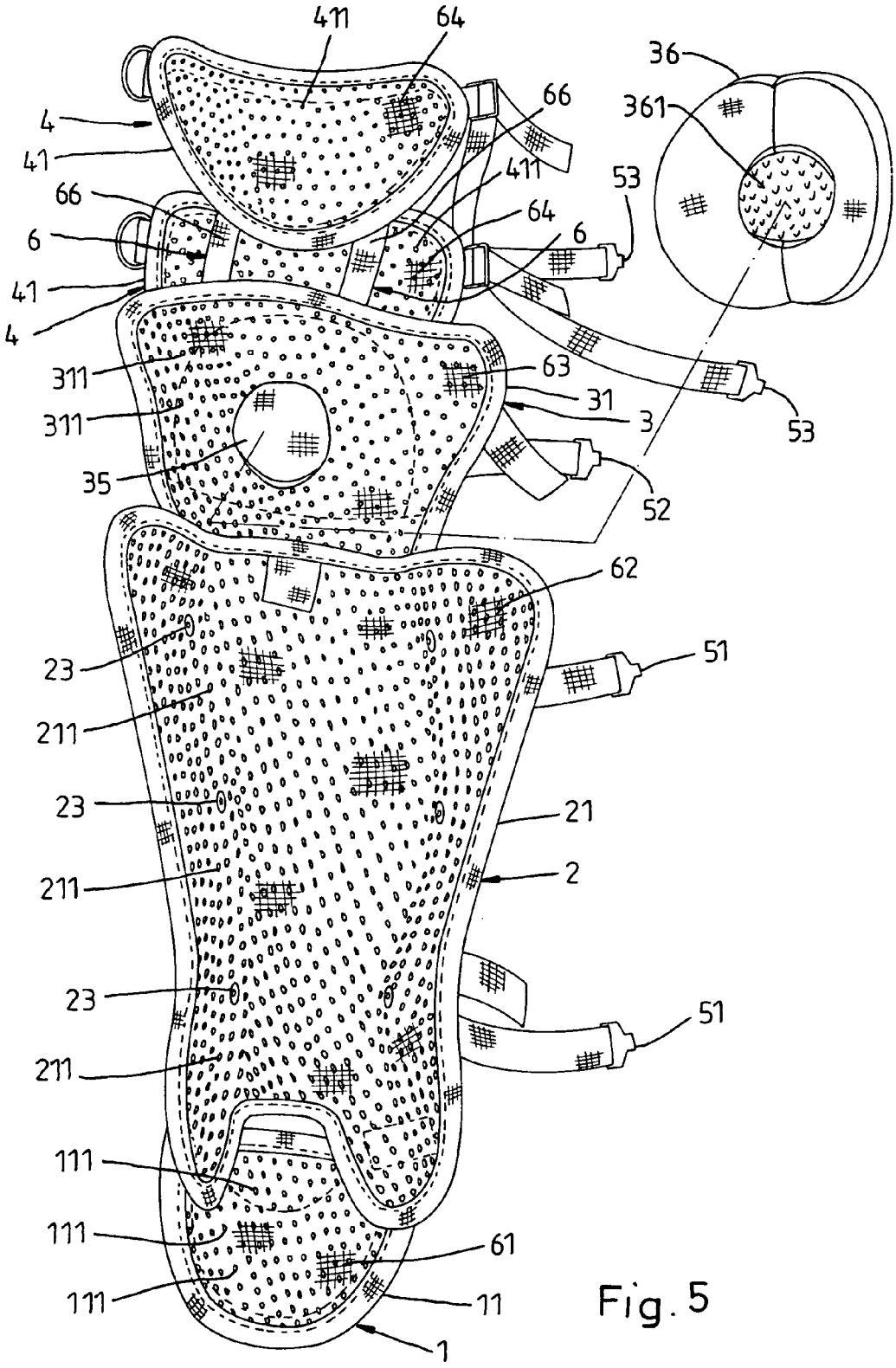
FIG. 5 is an exploded view of FIG. 4.
Figure 6:
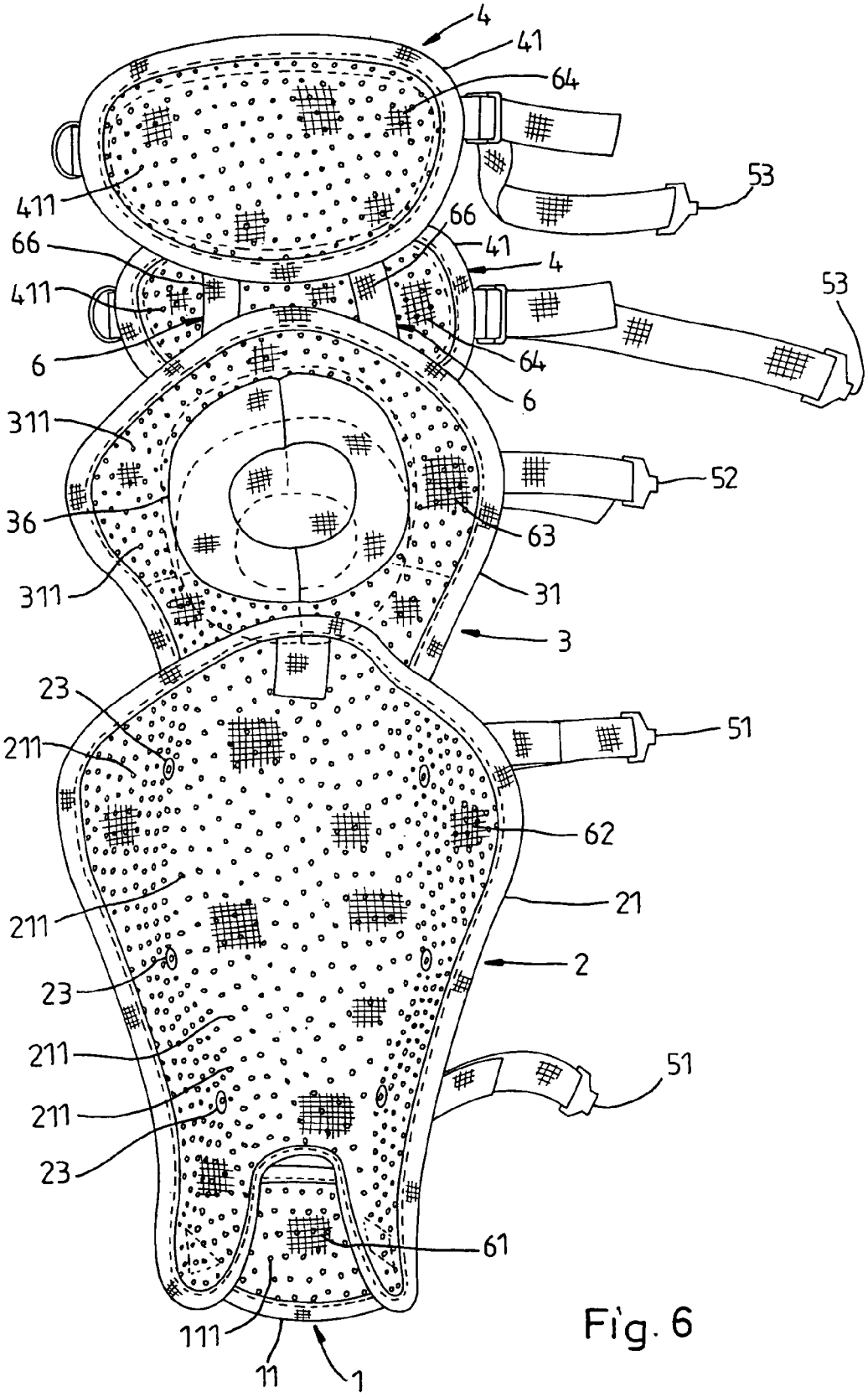
FIG. 6 is similar to FIG. 4 but showing position of the inner knee pad adjusted relative to the knee pad.

Referring to FIGS. 3~6, a catcher's leg guard in accordance with the present invention is shown comprising an ankle pad 1, a shin pad 2, a knee pad 3, a plurality of thigh pads 4, a plurality of connecting belts 6, a plurality of adjustment straps 51, 52, 53, and a plurality of breathing gauze cloth linings 61, 62, 63, 64.

The ankle pad 1 comprises a cushion pad 11, which has the top side thereof fixedly fastened to the bottom side of the shin pad 2 with rivets 24, and a cover shell 12 covered on the cushion pad 11 and affixed thereto with rivets 13 and stitches.

The shin pad 2 comprises a cushion pad 21, a cover shell 22 covered on the cushion pad 21 and affixed thereto with rivets 23 (or stitches), and a plurality of air vents 221, 222 respectively extended through the cover shell 22. The cover shell 22 has the top side thereof affixed to the knee pad 3 with rivets 34 (or stitches).

The knee pad 3 comprises a cushion pad 31, and a cover shell 32 covered on the cushion pad 31 and affixed thereto with rivets 33 and stitches.

The thigh pads 4 are connected in series, each comprising a cushion pad 41, and a cover shell 42 covered on the cushion pad 41 and affixed thereto with rivets 43 and stitches.

The connecting belts 6 each have a first end 65 fastened to the top side of the knee pad 3 with rivets or stitches (not shown) and a second end 66 fastened to the bottom side of the thigh pad 4 with rivets 44 or stitches (not shown).

The adjustment straps 51, 52, 53 are respectively stitched to the shin pad 2, the knee pad 3, and the thigh pad 4.

The breathing gauze cloth linings 61 62, 63, 64 are respectively stitched to the cushion pads 11, 21, 31, 41 at an inner side opposite to the respective cover shells 12, 22, 32, 42.

The main features of the present invention are outlined hereinafter. The cushion pads 11, 21, 31, 41 each have a plurality of air vents 111, 211, 311, 411. The air vents 211 of the cushion pad 21 of the shin pad 2 are in air-communication with the air vents 221, 222 of the cover shell 22 for exhaust of air upon an impact. As indicated, the breathing gauze cloth linings 61, 62, 63, 64 are covered on the respective cushion pads 11, 21, 31, 41 at an inner side over the respective air vents 111, 211, 311, 411. When wearing the catcher's leg guard, the user's leg is kept in direct contact with the breathing gauze cloth linings 61, 62, 63, 64, and currents of air can pass through the air vents 111, 211, 311, 411 and the open spaces in the breathing gauze cloth linings 61, 62, 63, 64. Therefore, the catcher's leg guard gives a comfort wearing.

Further, the cushion pads 11, 21, 31, 41 and the breathing gauze cloth linings 61, 62, 63, 64 are coated with a micro organism-resisting and mildew-retarding treatment agent.

The cushion pad 31 of the knee pad 3 has a center area provided with a first fastening element 35 (for example, hook or loop material), and an inner knee pad 36 is provided and detachably fastened to the cushion pad 31 of the knee pad 3. The inner knee pad 36 has an outer side provided with a second fastening element 361 (for example, loop or hook material), which is detachably connectable to the first fastening element 35. The second fastening element 361 can be fastened to the first fastening element 35 in any of a variety of positions (see FIG. 4 and FIG. 6) to accurately fit over the user's knee.

Further, the catcher's leg guard can be made having only one thigh pad or without the thigh pad to fit different users of different ages.

In conclusion, the invention achieves the following effects:

1. The cushion pads 11, 21, 31, 41 each have a plurality of air vents 111, 211, 311, 411; the air vents 211 of the cushion pad 21 of the shin pad 2 are in air-communication with the air vents 221, 222 of the cover shell 22 for exhaust of air upon an impact; the breathing gauze cloth linings 61,

62, 63, 64 are covered on the respective cushion pads 11, 21, 31, 41 at an inner side over the respective air vents 111, 211, 311, 411 and kept in direct contact with the user's leg to comfort the user.

2. The cushion pads 11, 21, 31, 41 and the breathing gauze cloth linings 61, 62, 63, 64 are coated with a micro organism-resisting and mildew-retarding treatment agent.

3. The inner knee pad 36 is detachably adjustably fastened to the cushion pad 31 of the knee pad 3 with hook and loop materials to accurately protect the user's knee.

What is claimed is:

1. A catcher's leg guard comprising:

an ankle pad, said ankle pad having a cushion pad and a cover shell covered on the cushion pad of said ankle pad, said ankle pad having a top side and a bottom side;

a shin pad, said shin pad comprising a cushion pad, a cover shell covered on the cushion pad of said shin pad, and a plurality of air vents respectively extended through the cover shell of said shin pad, the cover shell of said shin pad having a top side, and a bottom side affixed to the top side of said ankle pad;

a knee pad affixed to the top side of the cover shell of said thin pad, said knee pad comprising a cushion pad and a cover shell covered on the cushion pad of said knee pad;

a thigh pad, said thigh pad comprising a cushion pad and a cover shell covered on the cushion pad of said thigh pad;

a plurality of connecting belts connected between a top side of said knee pad and a bottom side of said thigh pad;

a plurality of adjustment straps respectively stitched to said shin pad, said knee pad, and said thigh pad; and a plurality of breathing gauze cloth linings respectively covered on the cushion pads of said ankle pad, said shin pad, said knee pad and said thigh pad at an inner side opposite to the respective cover shells;

wherein:

the cushion pads of said ankle pad, said shin pad, said knee pad and said thigh pad each have a plurality of air vents; the air vents of the cushion pad of said shin pad are in air-communication with the air vents of the cover shell of said shin pad; said the breathing gauze cloth linings are respectively covered on the cushion pads of said ankle pad, said shin pad, said knee pad and said thigh pad over the air vents in the cushion pads of said ankle pad, said shin pad, said knee pad and said thigh pad for direct contact with the user's skin.

2. The catcher's leg guard as claimed in claim 1, wherein the cushion pads of said ankle pad, said shin pad, said knee pad and said breathing gauze cloth linings are coated with a micro organism-resisting and mildew-retarding treatment agent.

3. The catcher's leg guard as claimed in claim 1, further comprising an inner knee pad for fastening to the cushion pad of said kneed pad, and hook and loop materials provided at said knee pad and said inner knee pad for enabling said inner need pad to be detachably adjustably fastened to said knee pad.

* * * * *